US005134792A

United States Patent [19]

Balbinot et al.

[11] Patent Number: 5,134,792

[45] Date of Patent: Aug. 4, 1992

[54] READ-FITTING SKI BOOT

[75] Inventors: Renzo Balbinot, Pieve Di Soligo; Vincenzo Bidoia, Castelfranco; Mario Mattiuzzo, Treviso; Cristiano Benetti, Postioma, all of Italy

[73] Assignee: Lange International, S.A., Fribourg, Switzerland

[21] Appl. No.: 759,748

[22] Filed: Sep. 12, 1991

Related U.S. Application Data

[63] Continuation of Ser. No. 544,994, Jun. 27, 1990.

[30] Foreign Application Priority Data

Jun. 28, 1989 [CH] Switzerland ..... 2399/89

[51] Int. Cl.[5] ..... A43B 5/04

[52] U.S. Cl. ..... 36/117; 36/119

[58] Field of Search ..... 36/117, 118, 119, 120, 36/121

[56] References Cited

U.S. PATENT DOCUMENTS

| | | | |
|---|---|---|---|
| 3,545,106 | 12/1970 | Martin | 36/120 |
| 4,644,670 | 2/1987 | Rochard et al. | 36/117 |
| 4,653,204 | 3/1987 | Morell et al. | 36/117 |
| 4,682,426 | 7/1987 | De Marchi | 36/117 |
| 4,694,592 | 9/1987 | Baggio et al. | 36/117 |
| 4,711,042 | 12/1987 | Morell et al. | 36/117 |
| 4,802,290 | 2/1989 | Marega | 36/119 |

FOREIGN PATENT DOCUMENTS

| | | | |
|---|---|---|---|
| 188818 | 7/1986 | European Pat. Off. | 36/119 |
| 328098 | 8/1989 | European Pat. Off. | 36/117 |
| 3132042 | 5/1982 | Fed. Rep. of Germany | 36/117 |

*Primary Examiner*—Paul T. Sewell
*Assistant Examiner*—Marie D. Patterson
*Attorney, Agent, or Firm*—Kane, Dalsimer, Sullivan, Kurucz, Levy, Eisele and Richard

[57] ABSTRACT

The boot is of the rear-fitting type and comprises a hinged upper consisting of two parts (3, 4) and provided with a first tensioning lever (6) acting on a cable, one end of which is connected to a second tensioner (9) permanently connected to the front part (3) of the upper. When the first tensioner (6) is closed, opening of the second tensioner (9) ensures sufficient relaxation of the upper to allow a rest position and facilitate walking.

11 Claims, 9 Drawing Sheets

READ-FITTING SKI BOOT

This is a continuation of copending application Ser. No. 07/544,994 filed on Jun. 27, 1990.

FIELD OF THE INVENTION

The present invention relates to a rear-fitting ski boot, comprising a shell surrounding the foot and the heel and an upper hinged on this shell, upper consisting of a front part and a rear part which can be tilted towards the rear in order to open the boot and which carries a first tensioning device acting on a cable, one end of which is anchored on one of the sides of the front part of the upper and the other end of which is secured to a second tensioning device connected, in the closed position of the boot, to the other side of the front part of the upper so as to clamp the upper around the ankle.

PRIOR ART

Such a boot is known from the French patents A-2,559,358 and 2,564,326. In these boots, the second tensioning device consists of a buckle engaging into one of the notches of a rack fixed onto the front part of the upper and forming a lever. In order to close and tighten the boot, the user first fastens the buckle onto the side of the upper, then lowers the tensioning lever located at the rear of the boot. No provision is made for a relaxation position, i.e. a position in which the boot is still closed, but clamping of the upper is slackened, such that the skier is able to rest or walk without difficulty. The side buckle is difficult to open and if the user manages to open it, this buckle tends to become unfastened.

The patent application Ser. No. EP 0,300,955 discloses a tensioning lever provided with an auxiliary relaxation device enabling the tension on the cable to be slackened. This tensioning lever is essentially intended for clamping the instep and the front of the foot, the relatively small degree of relaxation which can be obtained by means of the auxiliary device being sufficient to slacken clamping of the foot and allow the blood to circulate more freely in the veins of the foot.

The object of the present invention is to allow sufficient relaxation of clamping of the upper of the boot so as to ensure a good rest position and facilitate walking, without, however, the boot being completely open or the risk of a buckle becoming unfastened.

SUMMARY OF THE INVENTION

In the ski boot according to the invention the second tensioning device is permanently connected to the front part of the upper and it is formed so as to be able to be slackened from the clamped position of the upper.

This second tensioning device may be constructed in the form of a simple tensioning lever hinged on the front part of the upper and connected at an intermediate point to the clamping cable.

The second tensioning device may also consist of a part hinged by its front part, via at least one arm to the front part of the upper and performing substantially a movement of translation. The part therefore occupies the same position pressed against the boot, relative to the rear part of the upper, in the clamped position and in the relaxation position, such that the part never forms a pronounced projection on the boot.

The second tensioning device may also consist of a lever acting simultaneously on the end of a cable clamping the foot, such that, at the same time as relaxation of clamping of the ankle, there is also relaxation of clamping of the foot.

BRIEF DESCRIPTION OF THE DRAWINGS

The accompanying drawing shows, by way of example, five embodiments of the invention.

DESCRIPTION OF THE PREFERRED EMBODIMENT(S)

Figure 1:
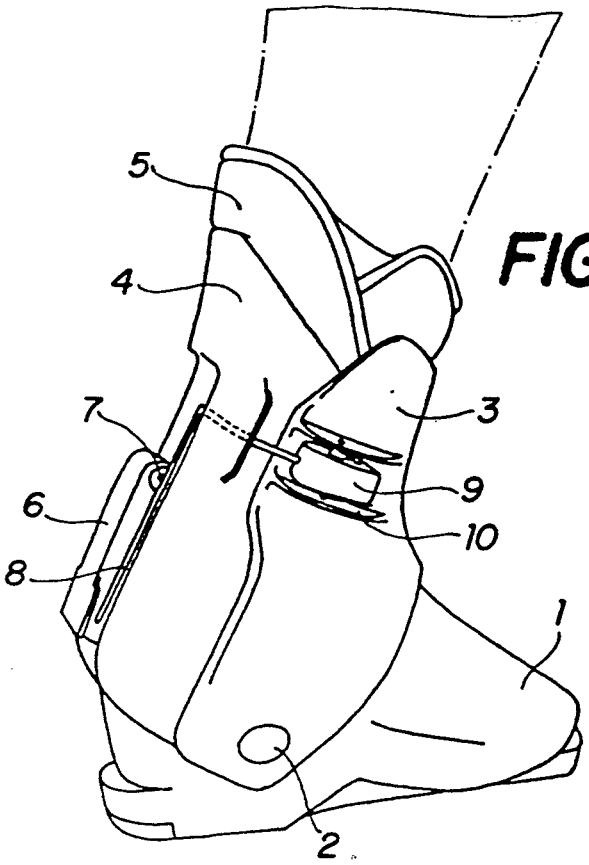
FIG. 1 shows a boot according to a first embodiment in the clamped position.
Figure 2:
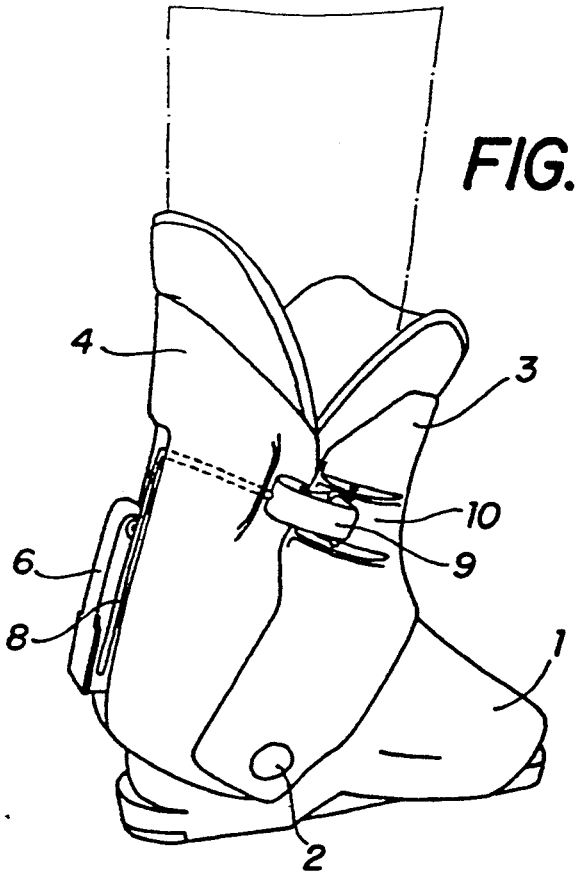
FIG. 2 shows the same boot in the relaxation position.
Figure 3:
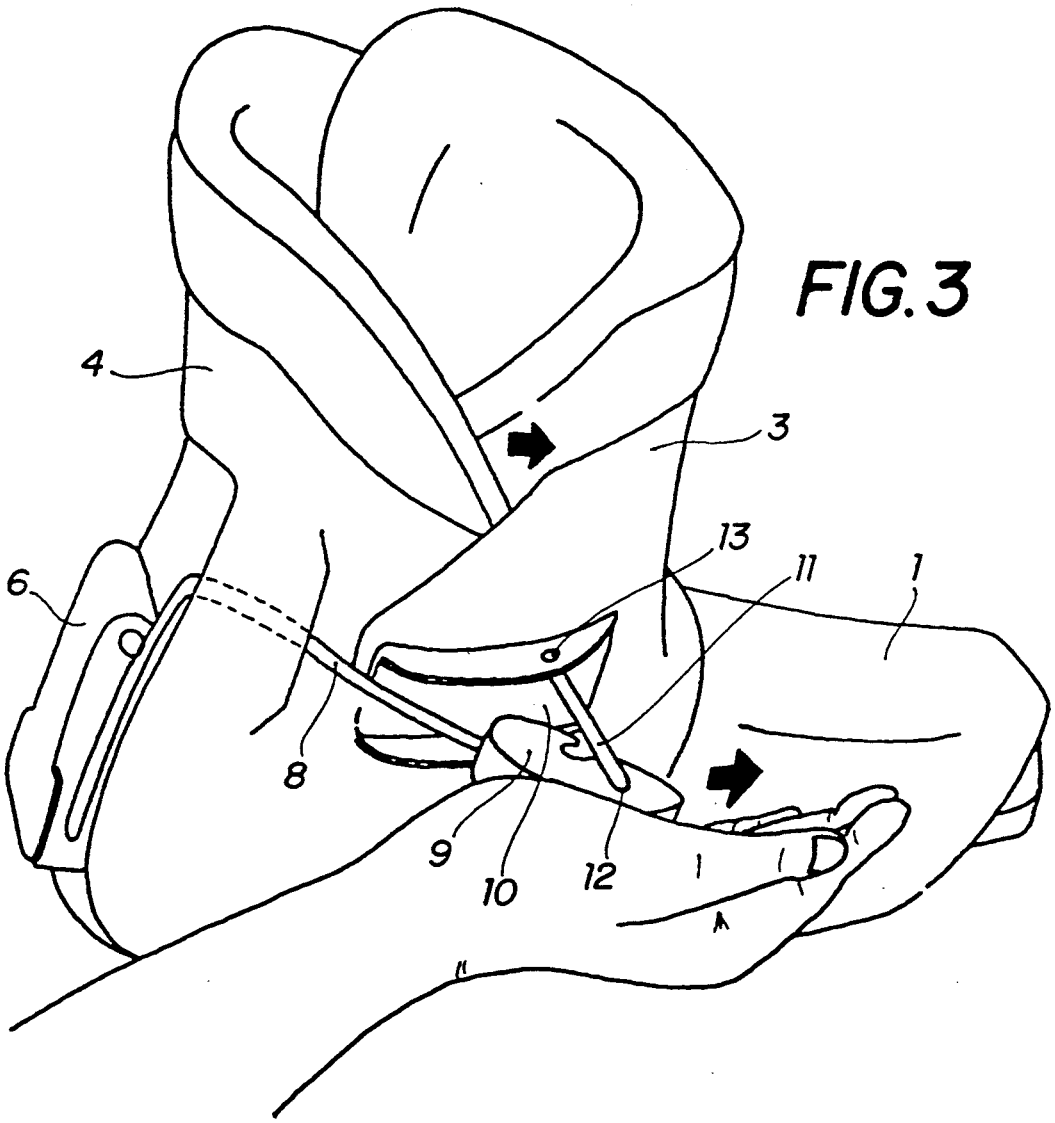
FIG. 3 shows the same boot during clamping.

The boot shown in FIGS. 1 to 3 comprises a shell 1 surrounding the foot and the heel and on which there is hinged by means of rivets 2 an upper consisting of a front part 3 able to tilt towards the rear so as to allow the foot to be introduced into the boot. The boot comprises moreover an inner slipper 5 of known design.

On the back of the rear part 4 of the upper there is mounted a tensioning lever 6 hinged about an axis 7 and to which there is attached a cable 8, one end of which is anchored on the left-hand side of the front part 3 of the upper, while its other end is fixed to a second tensioning device 9 consisting of a solid part, with a general rectangular shape, hinged on a base 10 by means of two connecting bars formed by the arms 11 of a U-piece passing through the part 9 (FIG. 3).

With the boot being in the clamped position, as shown in FIG. 1, if the skier wishes to slacken the clamping action, he/she needs only to separate the part 9 from the boot pulling the front end sideways and backwards. The part 9, by means of a movement corresponding practically to a translation, presses again against the boot in a relaxation position, as shown in FIG. 2. The degree of relaxation is determined by the length of the arms 11.

When the skier wishes to ski again, he/she merely has to push forwards the part 9 by pressing on it with the palm of the hand, as shown in FIG. 3. For this purpose, the part 9 is curved and has a surface which is rough, for example striated transversely. When the part 9 is again applied against the boot, as shown in FIG. 1, the direction of the pulling force of the cable 8 on the hinging axis 12 of the arms 11 on the part 9 passes between the hinging axis 13 of the arms 11 on the base 10 and the upper 3, such that there is a toggle effect keeping the device in the clamped position. In the case where the force clamping the upper is very great, it is of course possible to open first of all the tensioner 6 before pushing the part 9 forwards.

The tensioner 6 may of course be equipped with a tension adjusting device of the screw/nut type, such as that shown and described for example in the patent FR 2,564,326.

Figure 4:
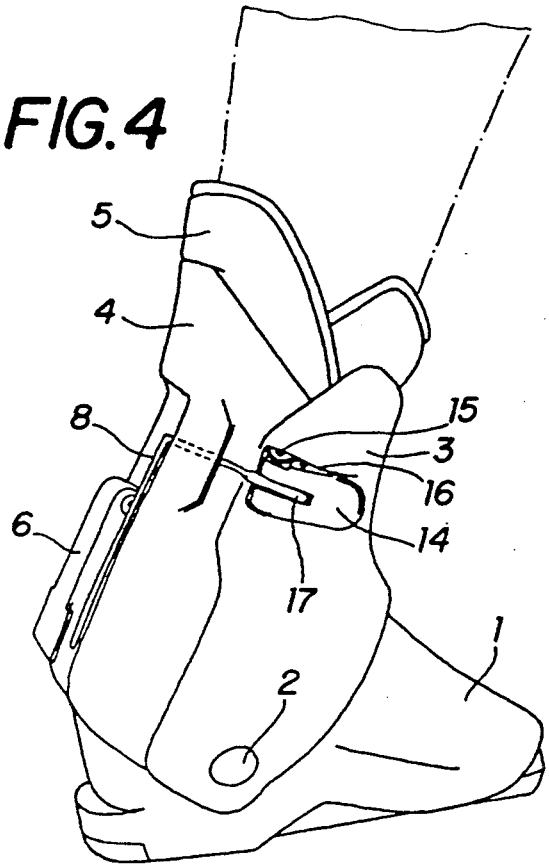
FIG. 4 shows a boot according to second embodiment in the clamped position.
Figure 5:
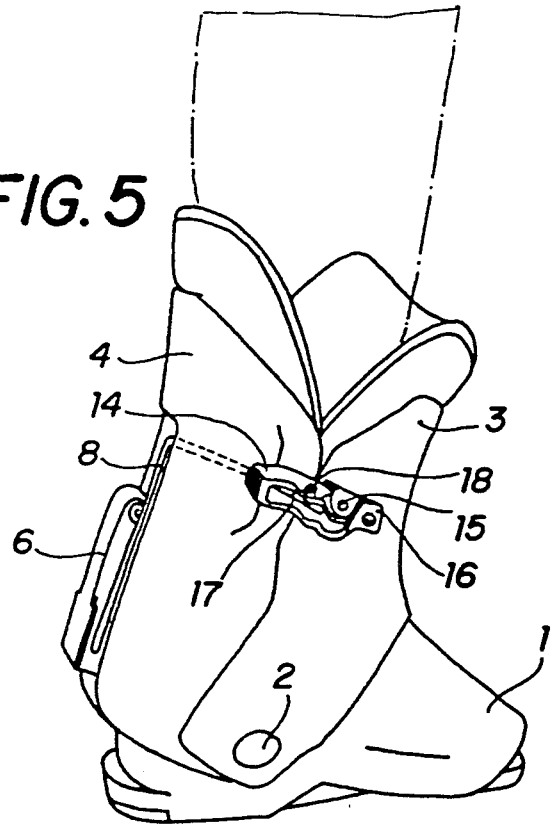
FIG. 5 shows the boot of FIG. 4 in the relaxation position.

The second embodiment shown in FIGS. 4 and 5 has the shell 1, the parts 3 and 4 of the upper, the rear tensioner 6 and the cable 8 of the first embodiment. The second tensioning device consists here of a tensioning lever 14 hinged about an axis 15 on a base 16 fixed on the front part 3 of the boot upper. The cable 8 is attached to this tensioner 14 by means of a bar 17 hinged on this tensioning lever 14 by means of a pivot 18. In the clamped position, shown in FIG. 4, the tensioning lever 14 is folded down forwards against the upper. In order to pass into the relaxation position, it is sufficient to separate the tensioning lever 14 from the upper and this lever folds back against the upper of the boot, slackening the tension on the cable 8.

Figure 6:
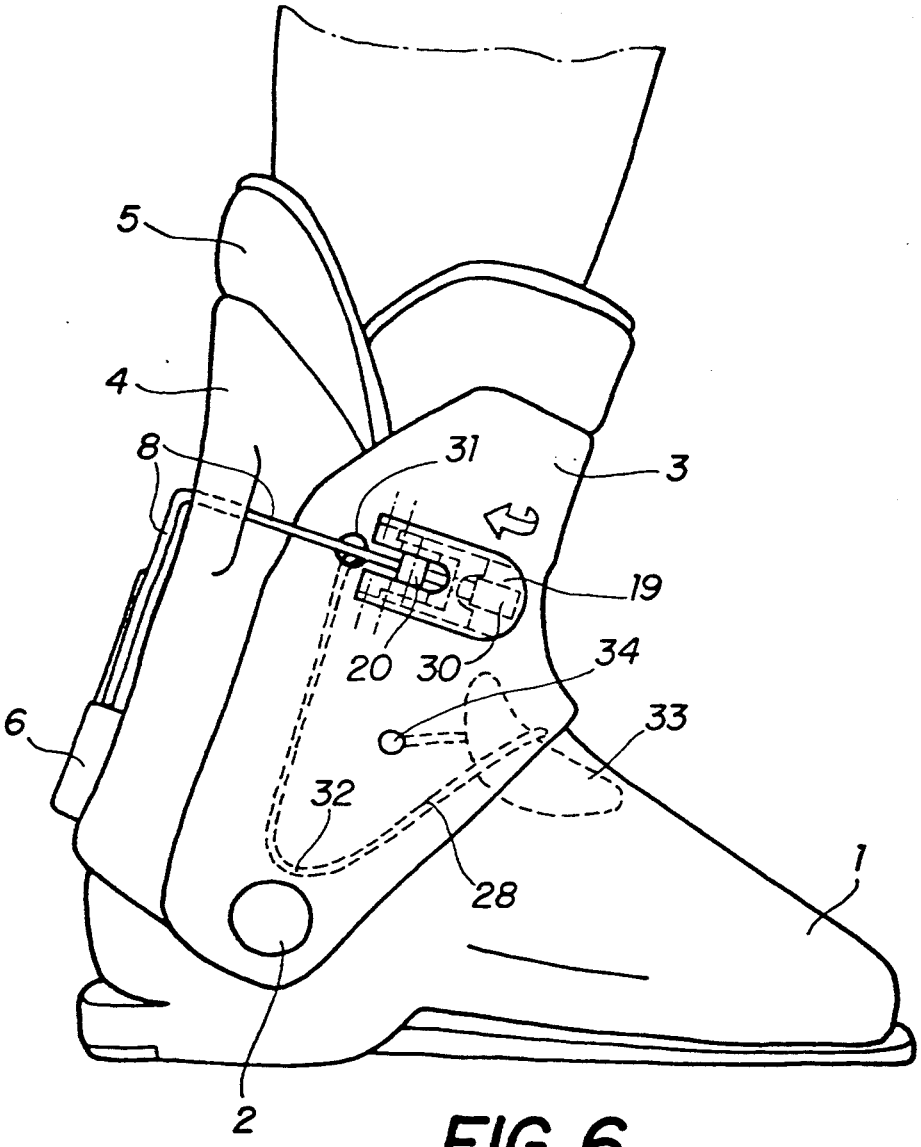
FIG. 6 shows a boot according to a third embodiment in the clamped position.
Figure 7:
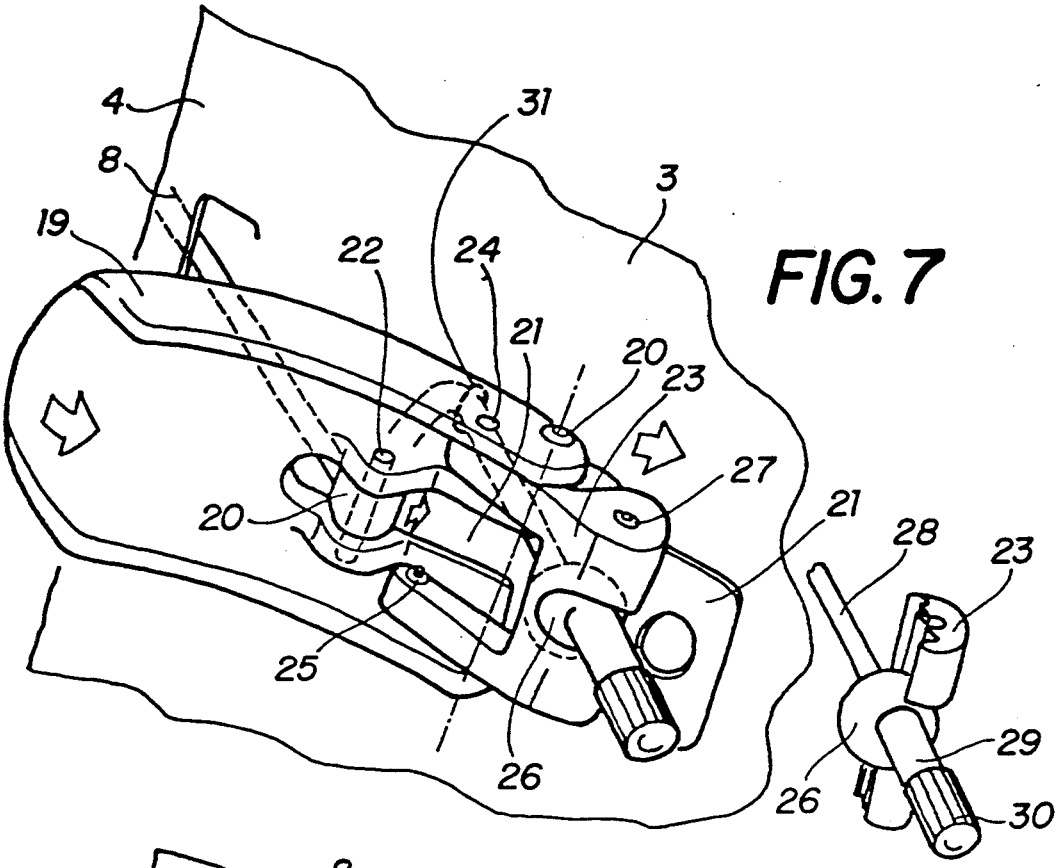
FIG. 7 shows a detail of the boot according to FIG. 6, in the relaxation position.
Figure 8:
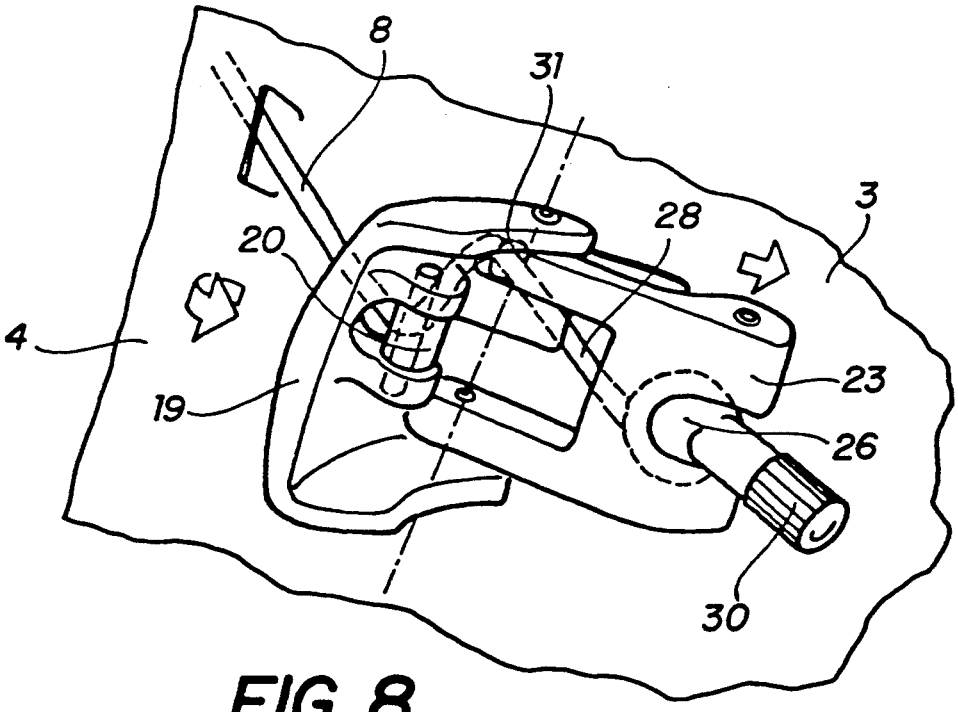
FIG. 8 shows the same detail during clamping.

The third embodiment shown in FIGS. 6 to 8 is a development of the second embodiment. It has a tensioning lever 19 similar to the tensioning lever 14. This tensioning lever 19 is hinged about an axis 20 on a base fixed to the front part 3 of the boot upper. The cable 8 is provided with a cylindrical cable end-piece 20 hinged in a recess 21 of the tensioning lever 19 about an axis 22. The tensioner 19 is provided moreover with a rocker link 23 in the shape of a stirrup, the ends of which are hinged at two points 24 and 22 on the tensioning lever 19, between the two axes 20 and 22. In the transverse part of the stirrup 23 there is hinged a boss 26 about an axis 27. This boss 26 is passed through by a cable 28, one end of which is integral with a threaded cylindrical stud screwed into a threaded sleeve 29 supported on the boss 26 and the end 30 of which is in the form of a knob for rotational operation. The cable 28 passes through the front part 3 of the upper via a hole 31, descends towards the hinging point 2, passes over a deflection means 32 inside the shell, then passes over a pressure distributor 33 situated on the instep, the other end of the cable being anchored on the other side of the shell at a point 34.

When the tensioning lever is folded down forwards against the boot, it simultaneously exerts both a tension on the cable 8 and on the cable 28, the latter clamping the foot inside the boot in a known manner. By folding down the tensioning lever 19 towards the rear, not only is the cable 8 relaxed, but the cable 28 is also relaxed, since the boss 26 moves towards the hole 31. This second relaxation is favourable since, in the rest position and for walking, it is not necessary for the foot to be clamped inside the boot as in the case of downhill skiing.

When the tensioning lever 19 is pushed forwards, as shown in FIG. 8, the rocker link 23, which is kept pressed against the boot by the residual tension on the cable 28, is pushed towards the front of the foot owing to the rotation of the axis 24 about the axis 20 and a tension is exerted on the cable 28. When the tensioning lever 19 is folded down into the position shown in FIG. 1, the foot is again clamped as it was before relaxation.

To take off the boot, the tensioning lever 6 is raised while the tensioning lever 19 is in the relaxation position, thereby enabling the boot to be opened wide and with greater ease, as in the preceding embodiments. The tensioning lever 19 is therefore a dual function lever since it performs, on the one hand, clamping of the ankle and, on the other hand, clamping of the foot. In this case, when the boot is put on, first a pre-clamping force is exerted by means of the tensioning lever 6 and then the ankle and the foot are clamped by means of the tensioning lever 19. Clamping of the foot may be adjusted by means of the knob 30.

According to a variation of embodiment not shown, the rocker link 23 consists of two metal arms hinged on an axis coaxial with the axis 22 and connected by a small rotatably mounted bar on which the threaded sleeve 30 is supported.

Figure 9:
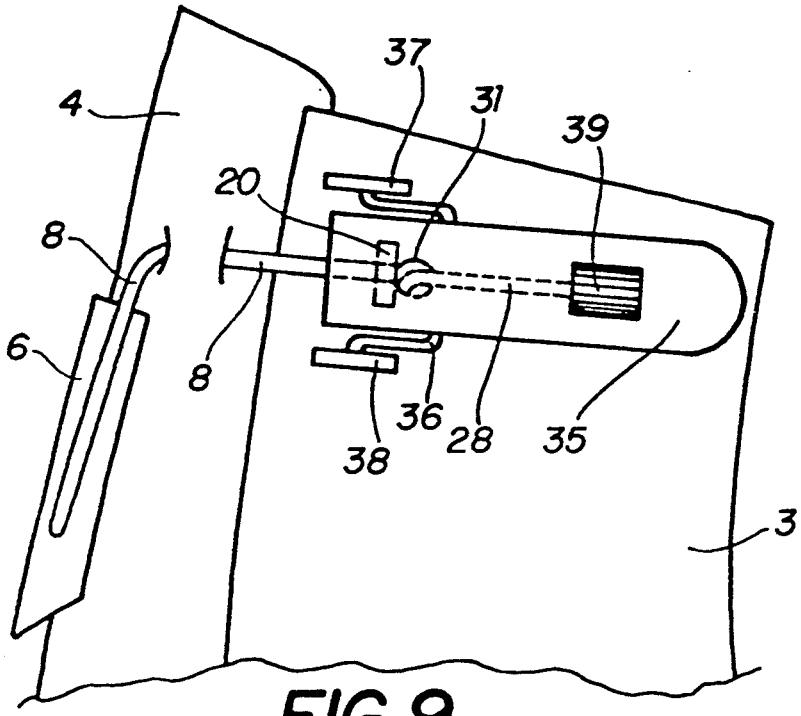
FIG. 9 shows, partially, a fourth embodiment in the clamped position.
Figure 10:
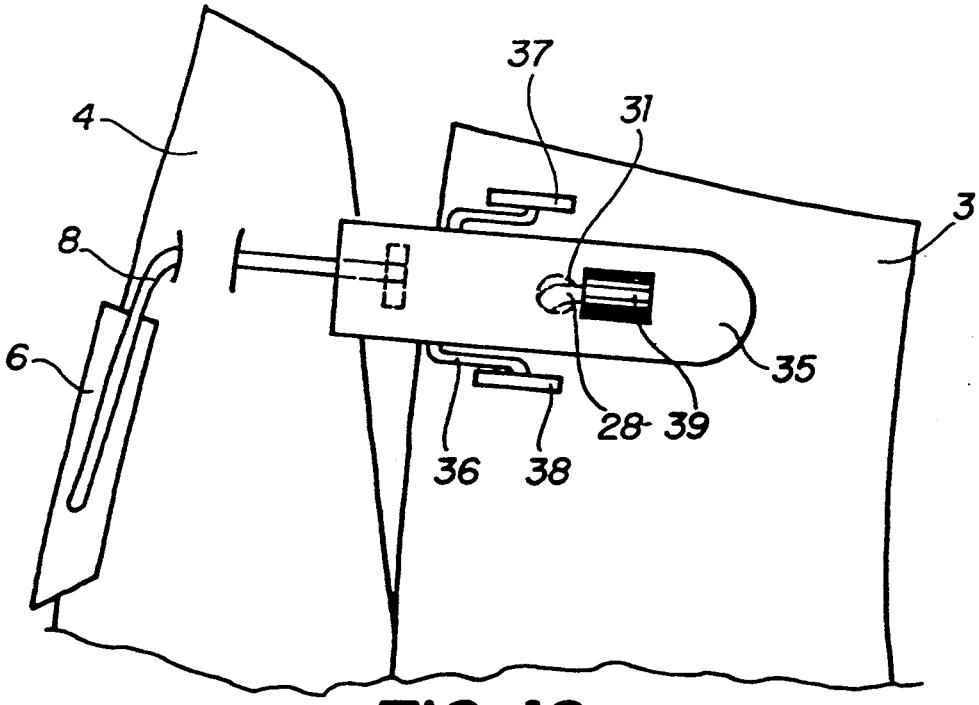
FIG. 10 shows this fourth embodiment in the relaxation position.

It is also possible to use a tensioner according to the first embodiment in order to perform simultaneous clamping of the foot. An example of embodiment is shown in FIGS. 9 and 10.

The boot is equipped with a part 35 similar to the part 9 of the first embodiment. This part 35 is hinged by a small U-shaped bar between the flanges 37 and 38 of a stirrup fixed to the front part 3 of the boot upper. As in the preceding embodiment, the end of a cable 28 is secured to the part 35 by means of an internally threaded sleeve 39 inside which there is screwed a threaded cylindrical stud to which the end of the cable 28 is fixed. The sleeve 39 is accommodated in a recess in the part 35 and rests on this part 35. The part 35 is used like the part 9 of the first embodiment and relaxation of the cable is effected as in the preceding embodiment.

In the two preceding embodiments, in which the second tensioning lever acts on a cable clamping the foot, the end of this clamping cable is pulled forwards, for which reason the cable enters into the boot at a point situated at the rear of the hinging point of the tensioning lever or very close to this hinging point and the cable undergoes at this point of entry a sudden change in direction. However, the suppleness of a metal cable is limited and sudden changes in direction form points of resistance and friction which oppose easy and uniform sliding of the cable, which occurs in particular when the cable is relaxed. The resistance is all the more great if there is no pulley or at least rounded guiding means. It is possible to eliminate this point of resistance using a construction and an arrangement such as that shown in FIGS. 11 to 15 which illustrate a fifth embodiment. The latter has, moreover, other advantages which will be highlighted during the description.

Figure 11:
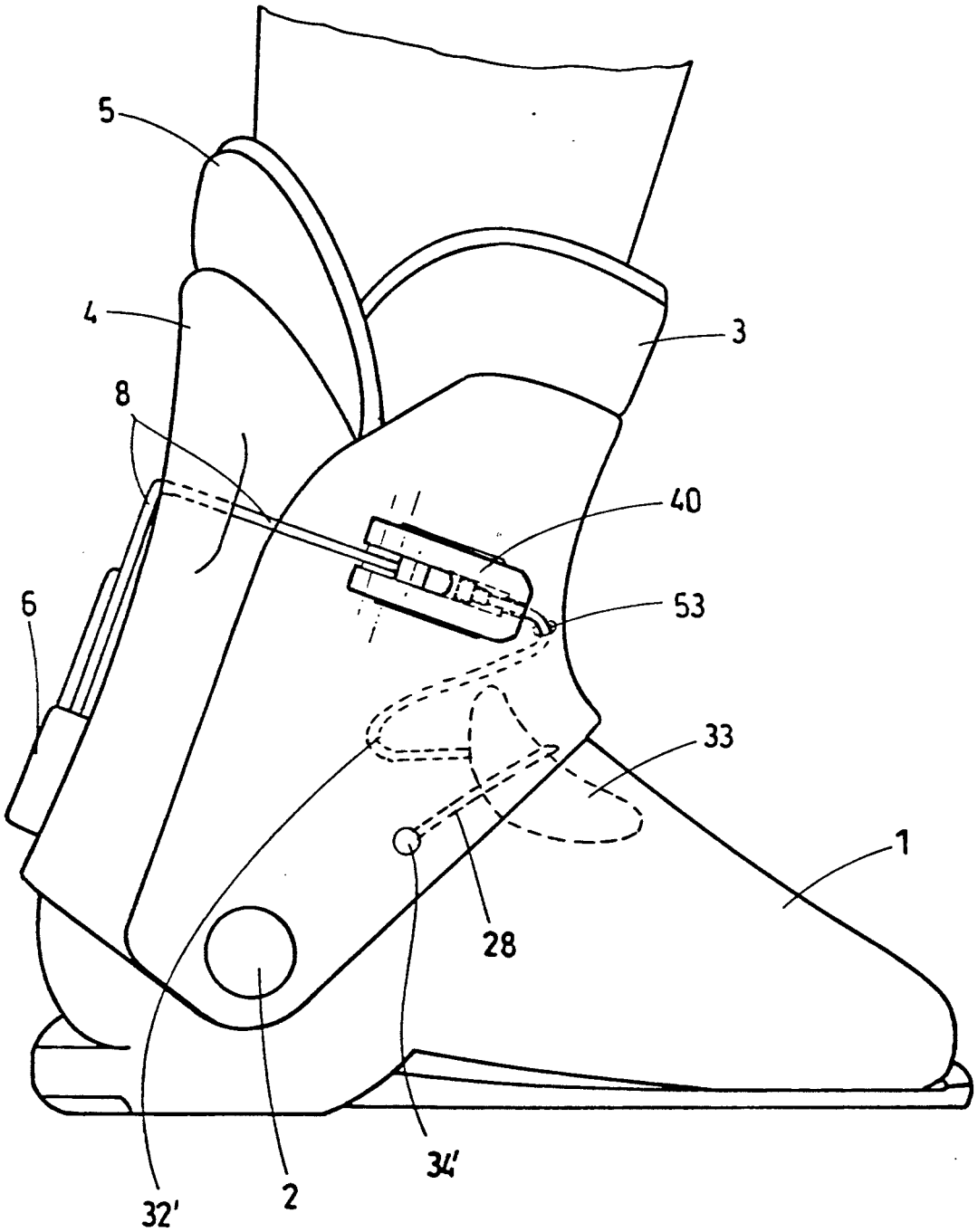
FIG. 11 shows a boot according to a fifth embodiment, related to the third embodiment.
Figure 12:
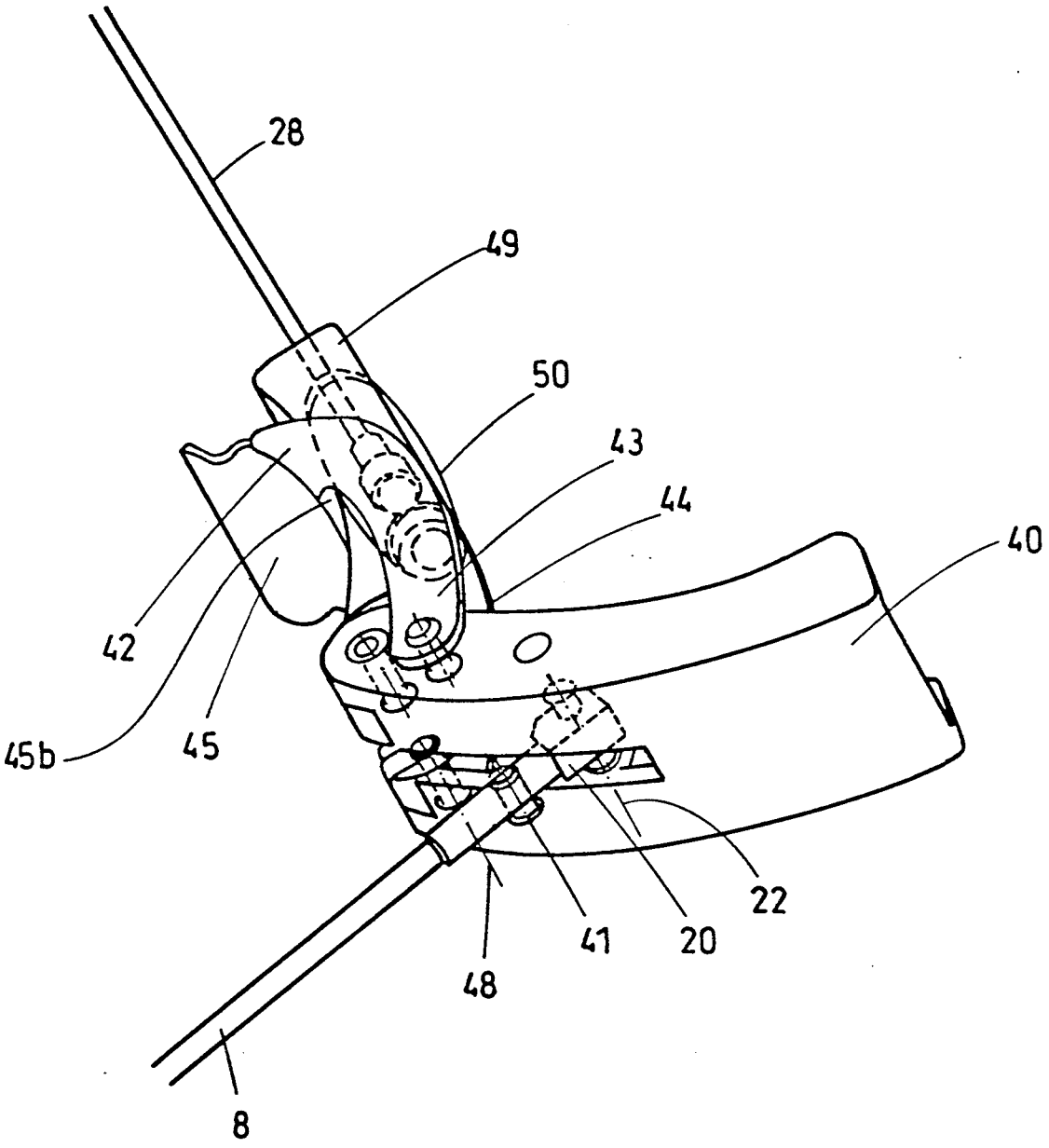
FIG. 12 is a perspective view of the second tensioning lever used in the fifth embodiment, in the partially open position.

In its general design, the boot shown in FIG. 11 is similar to the boot shown in FIG. 6. For the sake of simplification, the elements identical to those of FIG. 6 have the same reference numbers and will not be described again.

This fifth embodiment differs essentially from the third embodiment in the construction of the second tensioning lever. The latter consists of a tensioning lever 40 hinged at an intermediate point, about an axis 41, on a base 42, more precisely between two arms 43 and 44 of this base.

Figure 13:
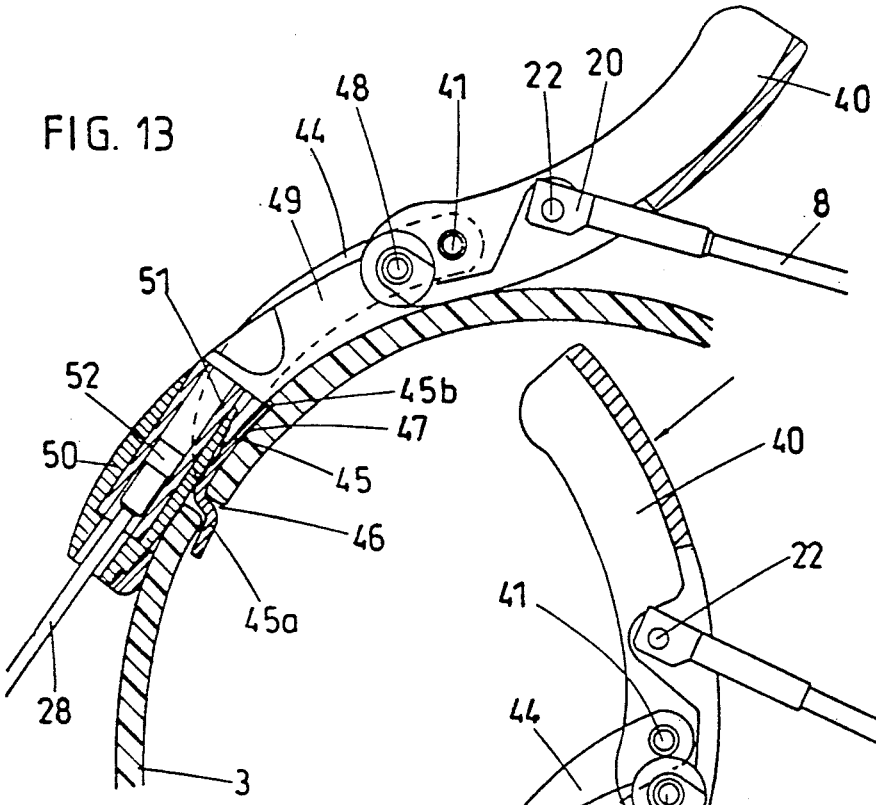
FIG. 13 is an axially sectioned view of the tensioning lever shown in FIG. 12, in the completely open position.

These two arms 43 and 44, slightly arched so as to match the curvature of the boot upper, are integral with a base 45 bent twice and engaged by means of this bent part into a slot 46 in the front part 3 of the upper, such that the end **45*a* hooks onto the inner wall of the upper. The rest of the base 45** is embedded in a countersunk region 47 of the part 3 of the upper, such that the transverse edge 45*b* of the base 45 bears against the end of the countersunk region 47 (FIG. 13). As in the third embodiment, the cable 8 is provided with a cable end-piece 20 hinged in a recess of the tensioner 40 by means of a pivot 22.

At the end of the tensioning lever 40 opposite to the hinging axis 22 relative to the axis 41, there is hinged, about an axis 48, one of the ends of a connecting part 49 also slightly curved so as to match the curvature of the boot upper. This connecting part 49 has a sleeve 50, slightly barrel-shaped, mounted rotatably in the connecting part 49. The sleeve 50 is provided with an internal thread 51 with which there is engaged a threaded cylindrical stud 52 forming the end-piece of the cable 28 clamping the foot. As can be seen in the drawing, the sleeve 50 protrudes slightly outside of the connecting part 49 so as to be able to be manually rotated for adjustment of the tension of the cable 28.

It will be noted that the cable 28 clamping the foot extends in the direction of the front of the boot, in the extension of the connecting part 49 (FIG. 11). The cable 28 enters into the boot at a point 53 situated in front of the tensioning lever 40 when the latter is in the closed position. The cable 28 forms a first harmonious loop of slight curvature in the direction of the inner side of the boot, the left-hand side in the case of the right-hand boot shown in FIG. 11. It then passes over a deflection point 32' formed on the inner face of the shell 1 and then over the pressure distributor 33 and is finally anchored at a point 34' on the opposite inner wall of the shell 1. Upon entering the boot, the cable 28 therefore does not undergo any significant and sudden change in direction. Friction is reduced to a minimum and the cable slides with maximum efficiency.

In FIG. 13, the tensioning lever 40 is shown in the totally open position. Clamping of the foot by the cable 28 is completely slackened and the partially released cable 8 allows a person to stand upright and walk. The base 42 and the connecting part 49 match the curvature of the upper forming a minimal projection.

Figure 14:
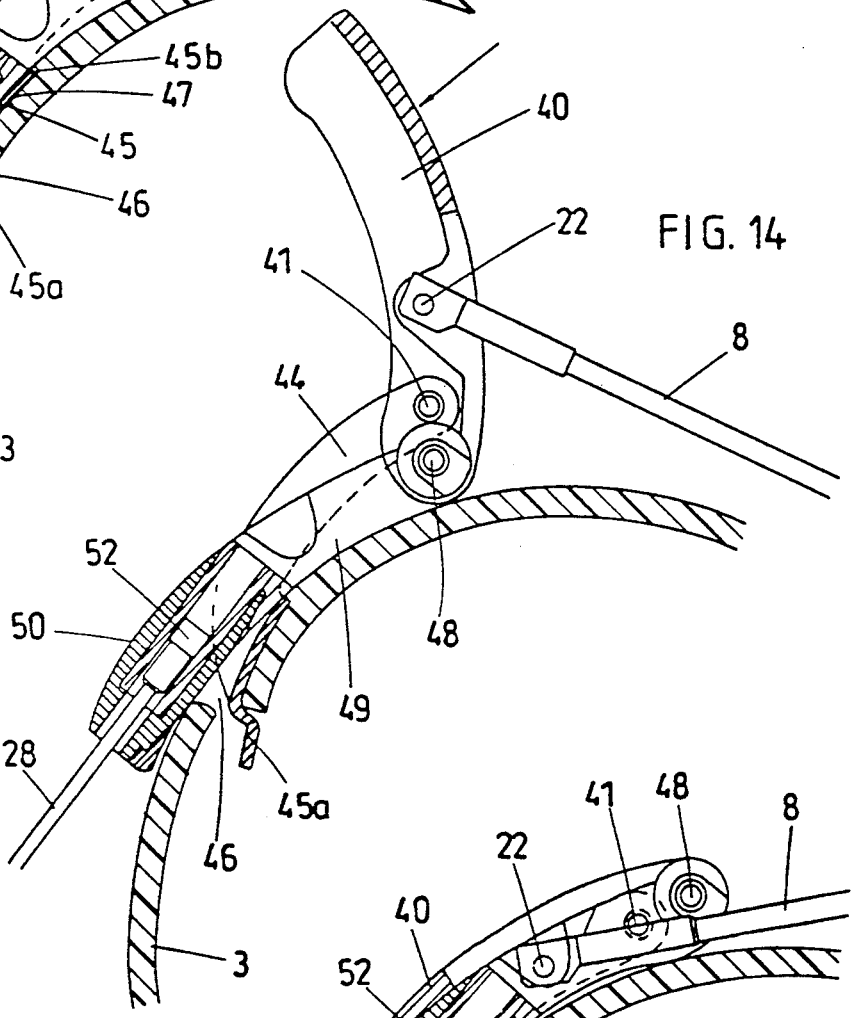
FIG. 14 shows the same tensioning lever in the partially open or closed position.
Figure 15:
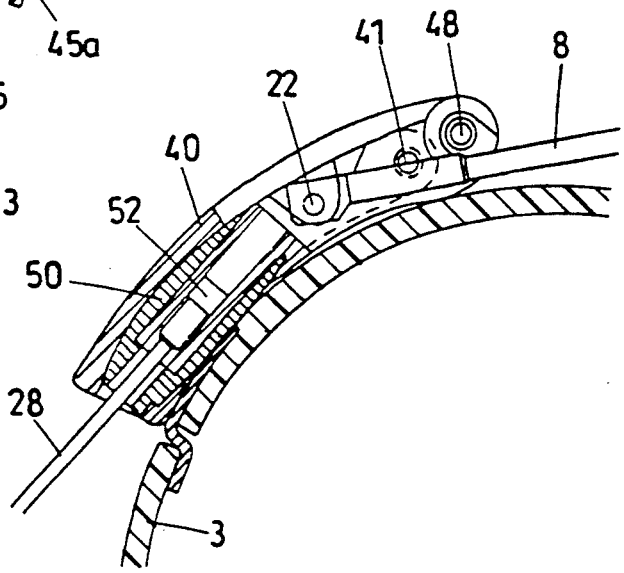
FIG. 15 shows the same tensioning lever in the closed position.

When the tensioning lever 40 is closed, its end with the hinging point 48 immediately strikes against the upper 3 of the boot, but the method of fixing the base 42 and the elasticity of the plastic material of the boot enables the base 42 to be separated from the boot as shown in FIG. 14. Once the straight line joining the hinging axes 41 and 48 has passed beyond the line perpendicular to the upper 3, the elastic deformation of the plastic material tends to cause the tensioning lever 40 to fold down against the boot, thus facilitating closure thereof. The tensioning lever 40 finally occupies the closed position shown in FIG. 15, position in which the tensioning lever, the connecting part and the base form a compact assembly in which the connecting part 49 and the threaded sleeve 50 are perfectly integrated into the tensioning lever.

The point of entry of the cable 28 into the boot must not be necessarily close to the tensioning lever 40, but the cable 28 could enter into the boot at a point situated in the vicinity of the vertical center plane of the boot or even on the other side of the boot.

Numerous variations of embodiment of the invention are of course possible. The tensioning lever 6 could in particular be replaced by a tensioner with a rotating drum or by a device with a rack and pawl. The tensioning lever 6 or the equivalent means used could simultaneously perform clamping of the foot inside the shell.

In the case of the third embodiment, the buckle 19 could be provided with a second stirrup 23 acting on an additional cable for clamping the front part of the foot.

We claim:

1. A rear-fitting ski boot, comprising a shell (1) surrounding the foot and the heel and an upper hinged on said shell, the upper comprising a front part (3) and a rear part (4) which can be tilted towards the rear in order to open the boot and which carries a first tensioning device (6), comprising a first fulcrum-based lever, acting on a cable (8), one end of which is anchored on one of the sides of the front part of the upper and the other end of which is secured to a second tensioning device (9; 14; 19; 35; 40) comprising a second fulcrum-based lever connected, in the closed position of the boot, to the other side of the front part of the upper so as to clamp the upper around the ankle, wherein the second tensioning device (9; 14; 35; 40) is permanently connected to the front part (3) of the upper and wherein it is formed so as to be able to be slackened from the clamped position of the upper without loss of tension regulation.

2. The boot as claimed in claim 1, wherein the second tensioning device comprising a part (9; 35) fixed to the end of the cable (8) and hinged on the front part of the upper by means of at least one bar (11; 36) having a hinging axis (12), the hinging axis (12) of said bar being situated on said part, in the clamped position of the upper, in front of a second hinging axis (13) on the front part of the upper and such that said part (9; 35) performs approximately a movement in translation and exerts a pulling force and that the direction of the pulling force on the hinging point of the bar on said part passes between the upper and the hinging point of the bar on the upper.

3. The boot as claimed in claim 2, wherein the said part (9; 35) has, externally a curved and rough surface and is hinged with the upper by a U-piece (11; 36), the lateral arms of which are positioned on either side of the curved part in the clamped position of the upper.

4. The boot as claimed in claim 1, wherein the second tensioning device comprises a tensioning lever (14; 19; 35; 40) hinged on the front part (3) of the upper, the cable (8) being secured to this tensioning lever by means of a part (17; 20; 49) hinged on this tensioning lever.

5. The boot as claimed in claim 4, comprising, inside the shell, means for clamping the foot comprising a clamping cable (28), one of the ends (34; 34') of which is anchored on one side of the shell and the other end of which is secured to a tensioning device, wherein the other end of the foot clamping cable is attached to the said tensioning lever (19; 35; 40) such that a pulling force is exerted on this foot clamping cable when the tensioning lever is closed.

6. The boot as claimed in claim 5, wherein the said clamping cable (28) passes through the front part (3) of the upper in the vicinity of the hinging point of the tensioning lever (19) and wherein the end of the said clamping cable is attached to the end of a rocker link (23) hinged on the side of the tensioning lever facing the upper, in the clamped position, about an axis (24) parallel to the hinging axis of the tensioning lever, such that the end of this rocker link is pushed towards the front of the boot when the tensioning lever is closed, exerting a pulling force on the foot clamping cable.

7. The boot as claimed in claim 6, wherein the end of the foot clamping cable attached to the tensioning lever, is provided with a cable end-piece in the form of threaded cylinder accommodated in a rotating threaded sleeve (29) supported on a boss (26) hinged with the end of the said rocker link (23).

8. A rear-fitting ski boot, comprising a shell (1) surrounding the foot and the heel and an upper hinged on this shell, the upper comprising a front part (3) and a rear part (4) which can be tilted towards the rear in order to open the boot and which carries a first tensioning device (6) acting on a cable (8), one end of which is anchored on one of the sides of the front part of the upper and the other end of which is secured to a second tensioning device (9; 14; 19; 35; 40) connected, in the closed position of the boot, to the other side of the front part of the upper so as to clamp the upper around the ankle, wherein the second tensioning device (9; 14; 19; 35; 40) is permanently connected to the front part (3) of the upper and wherein it is formed so as to be able to be slackened from the clamped position of the upper; wherein the second tensioning device comprises a tensioning lever (14; 19; 35; 40) hinged on the front part (3) of the upper, the cable (8) being secured to this tensioning lever by means of a part (17; 20; 49) hinged on this tensioning lever; said boot further comprising, inside the shell, means for clamping the foot comprising a clamping cable (28), one of the end (34, 34') of which is anchored on one side of the shell and the other end of which is secured to a tensioning device, wherein the other end of the foot clamping cable is attached to said tensioning lever (19; 35; 40) such that a pulling force is exerted on this foot clamping cable when the tensioning lever is closed; and wherein the tensioning lever (40) is hinged at an intermediate point (41) on a base (42), wherein the foot clamping cable (28) is attached, by means of a connecting part (49), to the end of the tensioning lever (40) opposite to the securing point (22) of the cable (8) clamping the upper relative to the hinge point (41) of said tensioning lever on the base and wherein the foot clamping cable (28) passes through the front part (3) of the upper at a point situated in front of said tensioning lever (4), on the opposite side of the boot.

9. The boot as claimed :n claim 8, wherein the base (42) is fixed to the boot by its end opposite to the hinging point (41) of the tensioning lever, such that the part of the base with the hinging point of the tensioning lever can be separated from the boot or may be folded down against the boot owing to the elastic deformation of the material of the boot.

10. The boot as claimed in claim 8, wherein the end of the foot clamping cable (28) attached to said connecting part (49) is provided with a cable end-piece in the form of a threaded cylindrical stud (52) engaged inside a sleeve (50) threaded internally and mounted rotatably on said connecting part (49).

11. The boot as claimed in claim 2, comprising, inside the shell, means for clamping the foot comprising a clamping cable (28), one of the ends of which is anchored on one side of the shell and the other end of which is secured to a tensioning device, wherein the part of the foot clamping cable extending towards the tensioning device passes through the front part (3) of the upper in the vicinity of the hinging point (37, 38) of the tensioning lever (35) for clamping the upper and wherein its end is secured to the said tensioning lever (35) by means of a cable end-piece in the form of a threaded cylinder accommodated in a rotating threaded sleeve (39) accommodated in a recess in the tensioning lever and resting on the tensioning lever.

* * * * *